US007152744B2

(12) United States Patent
Kunz et al.

(10) Patent No.: US 7,152,744 B2
(45) Date of Patent: Dec. 26, 2006

(54) DEVICE FOR WORKING SHEET-LIKE MATERIAL

(75) Inventors: Hans-Wolfgang Kunz, München (DE); Lukas Löffler, Diesenhofen (DE); Gerhard Schinzel-Reiner, München (DE); Alfred Schmidt, München (DE)

(73) Assignee: Giesecke & Devrient GmbH, Munich (DE)

( * ) Notice: Subject to any disclaimer, the term of this patent is extended or adjusted under 35 U.S.C. 154(b) by 323 days.

(21) Appl. No.: 10/297,923

(22) PCT Filed: Jun. 18, 2001

(86) PCT No.: PCT/EP01/06854

§ 371 (c)(1),
(2), (4) Date: Aug. 18, 2003

(87) PCT Pub. No.: WO01/99059

PCT Pub. Date: Dec. 27, 2001

(65) Prior Publication Data

US 2004/0225407 A1 Nov. 11, 2004

(30) Foreign Application Priority Data

Jun. 20, 2000 (DE) ..... 10030221

(51) Int. Cl.
*G07D 3/00* (2006.01)

(52) U.S. Cl. ..... 209/534; 194/206; 194/207

(58) Field of Classification Search ..... 209/534; 194/206, 207; 902/7
See application file for complete search history.

(56) References Cited

U.S. PATENT DOCUMENTS 4,166,030 A * 8/1979 Lewis et al. ..... 209/534

(Continued)

FOREIGN PATENT DOCUMENTS

DE 30 33 718 C3 3/1981

(Continued)

*Primary Examiner*—Patrick Mackey
*Assistant Examiner*—Matthew J. Kohner
(74) *Attorney, Agent, or Firm*—Bacon & Thomas

(57) ABSTRACT

The present invention relates to an apparatus for processing sheet material, in particular bank notes, papers of value and the like.

Figure 1:
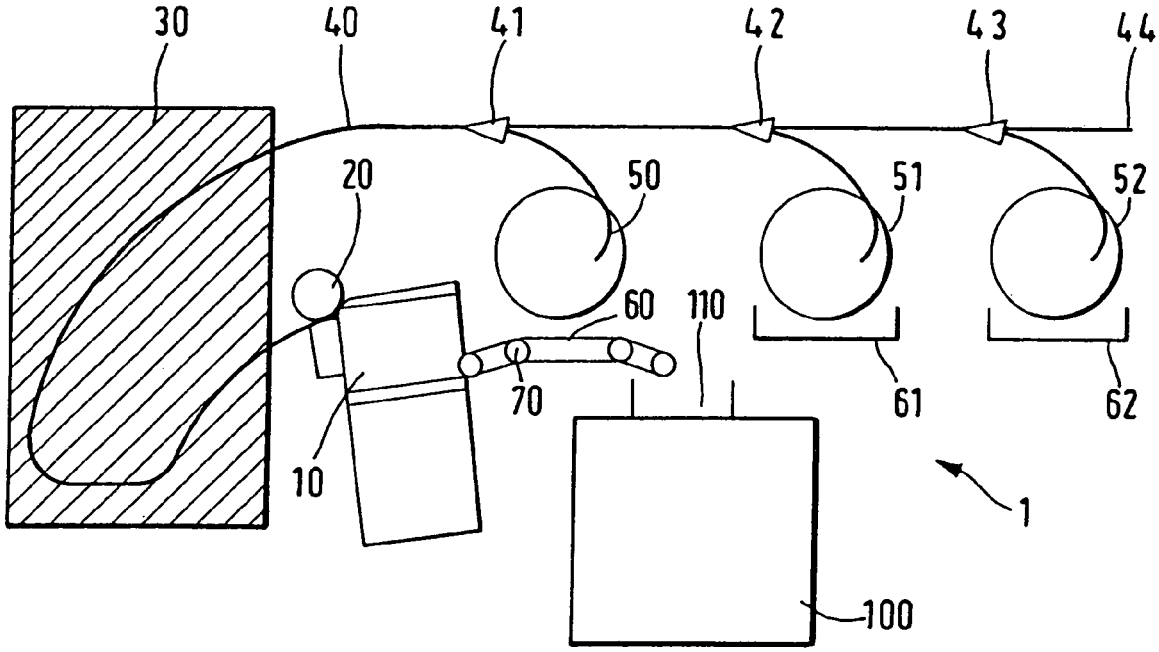

In the inventive apparatus, an automatic return of sheet material to a second or, generally speaking, further check is provided, which obtains relief for an operator of the apparatus. The relief results from a reduction of the rate of indeterminable cases or the total sheet material to be manually reworked, since any disturbances or faulty operating conditions existing at the time of a first or, generally speaking, prior check of sheet material normally no longer exist, or exist in a changed form, at the time of a second or, generally speaking, further check of the sheet material. The correct check and assignment of the sheet material is thus possible in the second or, generally speaking, further check.

19 Claims, 2 Drawing Sheets

U.S. PATENT DOCUMENTS

| | | | | | |
|---|---|---|---|---|---|
| 4,236,639 | A | * | 12/1980 | Boettge et al. | 209/534 |
| 4,357,528 | A | * | 11/1982 | Smith et al. | 377/8 |
| 4,398,088 | A | * | 8/1983 | Hirose et al. | 235/379 |
| 4,402,410 | A | * | 9/1983 | Ohba et al. | 209/534 |
| 4,483,124 | A | | 11/1984 | Ohba et al. | |
| 4,511,794 | A | * | 4/1985 | Imamichi | 235/379 |
| 4,542,287 | A | * | 9/1985 | Watanabe | 235/379 |
| 4,571,489 | A | * | 2/1986 | Watanabe | 235/379 |
| 4,722,443 | A | * | 2/1988 | Maruyama et al. | 209/534 |
| 4,866,254 | A | * | 9/1989 | Okayama et al. | 235/379 |
| 4,972,958 | A | * | 11/1990 | Ito et al. | 209/534 |
| 4,980,543 | A | * | 12/1990 | Hara et al. | 235/379 |
| 5,186,334 | A | * | 2/1993 | Fukudome et al. | 209/534 |
| 5,205,019 | A | | 4/1993 | Schnlichter et al. | |
| 5,649,627 | A | * | 7/1997 | Wako | 209/534 |
| 5,815,592 | A | * | 9/1998 | Mennie et al. | 382/135 |
| 5,853,089 | A | * | 12/1998 | Milne | 209/534 |
| 5,905,810 | A | * | 5/1999 | Jones et al. | 382/135 |
| 5,909,814 | A | * | 6/1999 | Arikawa | 209/534 |
| 5,992,601 | A | * | 11/1999 | Mennie et al. | 194/207 |
| 6,000,555 | A | * | 12/1999 | Anma | 209/534 |
| 6,151,534 | A | * | 11/2000 | Smith et al. | 700/223 |
| 6,578,713 | B1 | * | 6/2003 | Matsuura et al. | 209/534 |
| 6,581,746 | B1 | * | 6/2003 | Lundblad | 194/206 |
| 6,640,156 | B1 | * | 10/2003 | Brooks et al. | 700/213 |
| 6,659,340 | B1 | * | 12/2003 | Siemens | 235/379 |
| 6,771,180 | B1 | * | 8/2004 | Mizuta et al. | 340/674 |
| 2002/0100660 | A1 | * | 8/2002 | Stieber et al. | 194/215 |

FOREIGN PATENT DOCUMENTS

| | | | | |
|---|---|---|---|---|
| DE | 37 08 317 | C2 | | 6/1988 |
| DE | 41 29 882 | A1 | | 3/1992 |
| DE | 43 17 250 | A1 | | 1/1994 |
| EP | 0 714 078 | A | | 5/1996 |
| EP | 0 881 603 | A | | 12/1998 |
| EP | 0 903 701 | A | | 3/1999 |
| EP | 0 952 556 | A | | 10/1999 |
| JP | 54119297 | A | * | 9/1979 |
| JP | 2004157624 | A | * | 6/2004 |
| WO | WO 96 30879 | A | | 10/1996 |

* cited by examiner

DEVICE FOR WORKING SHEET-LIKE MATERIAL

The present invention relates to an apparatus for processing sheet material, in particular bank notes, papers of value and the like.

DE 27 60 269 C2 discloses an apparatus for automatic sorting of thin sheet material having an input pocket for receiving bank notes, a singling device, a transport system, a checking device disposed along the transport system and at least one deposit device. In accordance with the results of the checking device, sheet material is divided into cases fit for circulation, cases unfit for circulation and indeterminable cases, the fit and unfit sheet material being transported to different deposit devices and the indeterminable cases stored in a buffer. Data on the deposited sheet material are stored in data memory. These data are used for, among other things, preparing a protocol that permits a statement about the indeterminable cases. The protocol is used at a manual reworking station for evaluating and checking by hand the indeterminable cases taken from the buffer. The result of the manual check can be inputted to the data memory to complete the data.

The known apparatus thus has the advantage that the automatic sorting process can be continued when indeterminable cases occur, since the indeterminable cases are deposited in a buffer and can be evaluated and checked by means of the prepared protocol at a later time or else simultaneously with the automatic sorting process. The apparatus can therefore be operated at maximum throughput without interruption.

However, the known apparatus has the disadvantage that when indeterminable cases occur frequently, this necessitates elevated effort for manual reworking at the manual reworking station. Since the operator of the automatic sorting apparatus frequently also does the reworking of the indeterminable cases at the manual reworking station parallel to automatic sorting, as known e.g. from EP 0 952 556 A2, this nevertheless results sooner or later in an influence on operation that reduces throughput. This problem is increased further by the fact that sheet material that cannot be processed by the apparatus because of faulty processes in the apparatus is frequently additionally transported into the buffer or a further buffer. Such faulty processes can arise e.g. through simultaneous removal of more than one piece of sheet material by the singling device, skewed transport of sheet material, etc. Altogether, this increases the rate of sheet material to be manually reworked and thus the effort required for the operator. It is known from EP 0 714 078 A1 and U.S. Pat. No. 4,398,088 to supply determinate cases to a recheck by the bank note processing machine.

It is also known to design the manual reworking station as a counting machine to relieve the operator when counting indeterminable cases. The disadvantage here is that the total quantity of sheet material to be reworked manually is not reduced. If the counting machine used as the manual reworking station can also perform a check, the absolute quantity of indeterminable cases is reduced but it is nevertheless necessary for the operator to handle all indeterminable cases.

It is the problem of the present invention to state an apparatus for processing sheet material, in particular bank notes, papers of value and the like, that leads to a reduction of manual reworking and sheet material to be manually reworked.

This problem is solved according to the invention by the features of claim 1.

The basic idea here is that repeating the check of sheet material by means of a further sheet material processing apparatus reduces the rate of indeterminable cases or of total sheet material to be manually reworked. For this purpose an automatic return of sheet material ti a second or, generally speaking, further check is provided, thereby obtaining relief for an operator of the apparatus. The reduction of the rate of indeterminable cases or total sheet material to be manually reworked results from the fact that any disturbances or faulty operating conditions, caused e.g. by tolerances or stochastic influences, existing at the time of a first or, generally speaking, prior check of sheet material normally no longer exist, or exist in a changed form, at the time of a second or, generally speaking, further check of sheet material. Correct checking and assignment of sheet material is thus possible upon the second or, generally speaking, further check.

Figure 2:
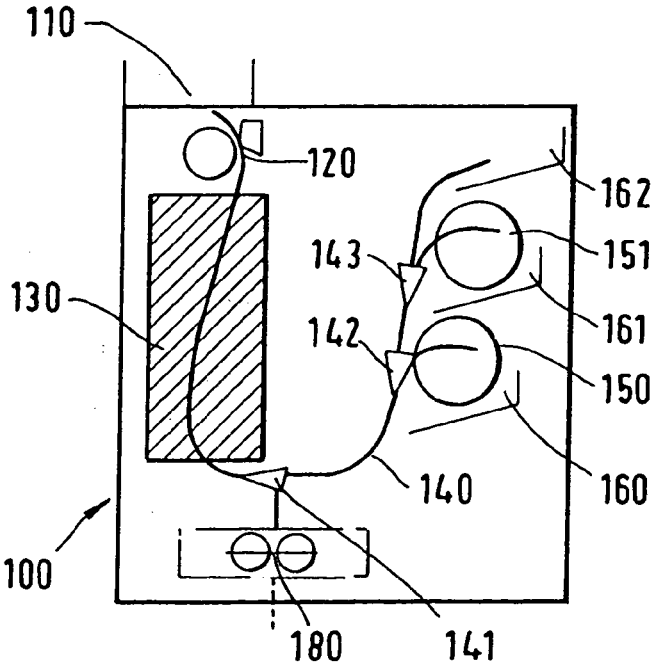
Figure 3:
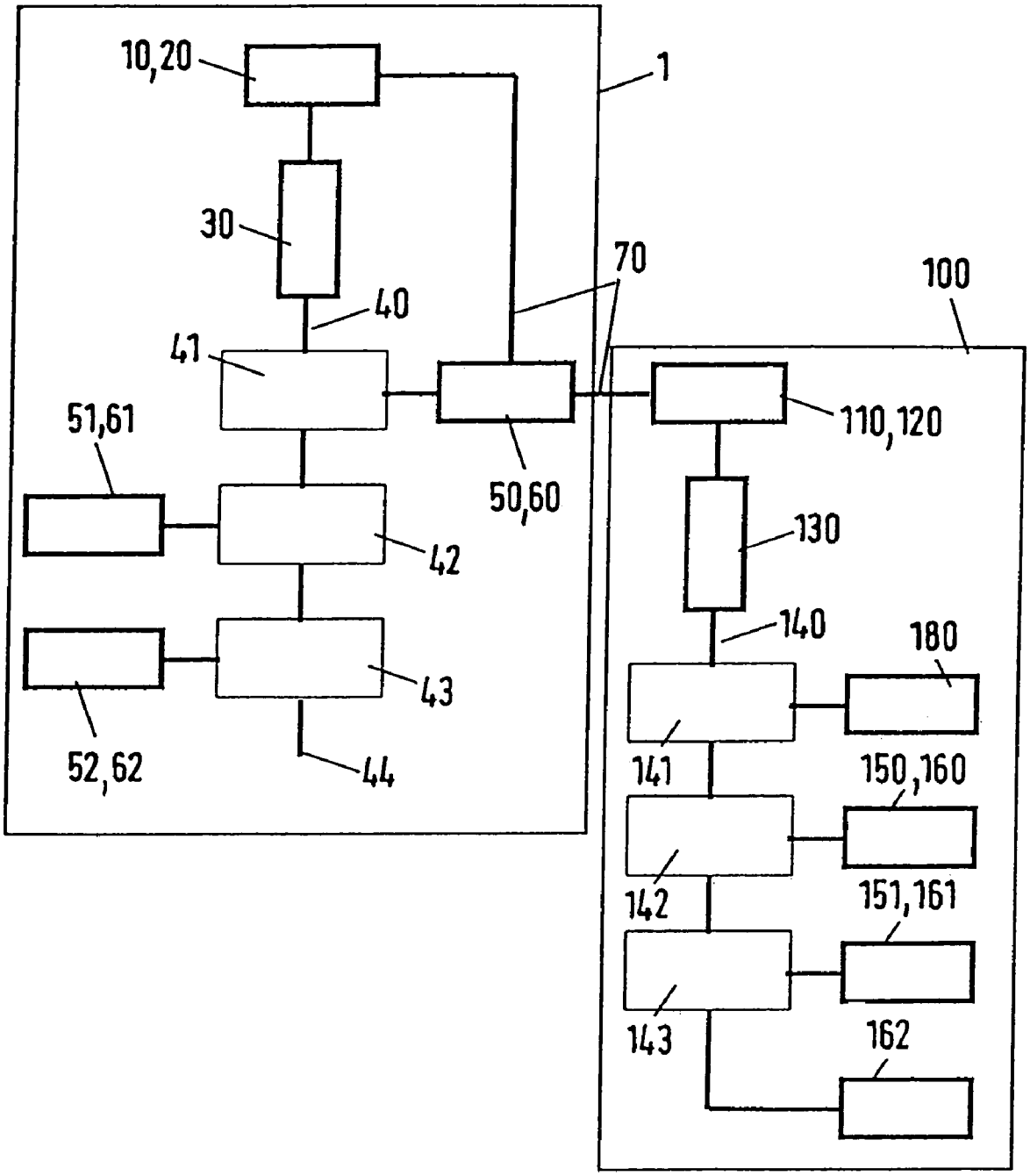

The invention will be explained in the following in more detail with reference to figures, in which:

FIG. 1 shows a schematic representation of an embodiment of an inventive sheet material processing apparatus, FIG. 2 shows a schematic representation of a detail of the apparatus according to FIG. 1, and FIG. 3 shows the embodiment according to FIG. 1 in a flowchart.

Similar elements shown in the figures are marked by the same reference signs.

FIG. 1 shows a schematic representation of an embodiment of inventive sheet material processing apparatus 1.

Apparatus 1 contains input pocket 10 for inputting a stack of sheets, singler 20 for singling sheet material forming the stack of sheets so that a single piece of sheet material is always inputted into transport system 40. Transport system 40 leads through checking device 30 where sheet material is checked. Checking device 30 is constructed in known fashion and contains for example optical, mechanical, magnetic and acoustic sensors for checking the sheet material. If the sheet material to be checked is formed by bank notes, the check performed by the checking device can consist for example in checking the authenticity of the bank notes and their fitness with respect to soiling and wear. On the basis of the sheet material check performed by checking device 30, sheet material is supplied to different deposit devices 50, 60, 51, 61, 52, 62. For this purpose, diverters 41, 42, 43 located in transport system 40 are activated by checking device 30 in dependence on the check result. Checking device 30 contains a controller, which can be formed for example by a microprocessor, for performing both the evaluation of data delivered by the sensors and the control of the individual components of apparatus 1. Deviating from this, it can be provided that there is not only a controller in checking device 30 for evaluating the sensor signals but also a further controller for performing the control of the individual components of apparatus 1 in dependence on the results of checking device 30. Extension 44 of transport system 40 indicates that the apparatus can have further deposit devices or other devices, for example a shredder.

Deposit devices 50, 60, 51, 61, 52, 62 can be formed for example by known spiral slot stackers. The spiral slot stackers have rotating units 50, 51, 52 with pockets disposed in a spiral shape into which sheet material is introduced by transport system 40. A stripping device engaging the rotating unit is used to remove sheet material from the individual pockets and place and stack it in bins 60, 61, 62.

When a stack of sheets is inserted into singling device 10, 20 consisting of input pocket 10 and singler 20, the individual pieces of sheet material contained in the stack are singled by singler 20 and supplied to transport system 40 to be checked in checking device 30.

If the sheet material consists for example of bank notes and the latter are to be sorted according to fitness, it can be provided that bank notes recognized as authentic and having very good fitness are placed in deposit device 51, 61. Bank notes recognized as authentic and having good fitness are placed in deposit device 52, 62. Bank notes recognized as authentic but with poor fitness are for example transported by transport system 40 via extension 44 into a shredder for immediate destruction. During processing of the bank notes the control device contained in checking device 30, or the separate control apparatus, detects how many bank notes have been classified as very good, good or poor and supplied to the corresponding deposit devices and the shredder. It can also be provided that the denomination of the individual bank notes is recognized and information about the denomination of the individual bank notes and the total value of bank notes supplied to the individual deposit devices and the shredder is additionally determined and stored for later evaluation.

It is likewise possible to sort according to other criteria of the sheet material, or bank notes, e.g. according to denomination, currency, position, orientation, etc.

Sheet material or bank notes that cannot be recognized by checking device 30 or whose processing in checking device 30 causes problems or whose recognition is incomplete, so-called reject cases, are placed and stacked in deposit device 50, 60.

After the stack of sheets inserted in singling device 10, 20 has been worked off, the control device contained in checking device 30, or the separate control device, activates transport device 70 connected with bin 60 of deposit device 50, 60. Transport device 70 is connected on the other hand with singling device 10, 20 and supplies sheet material, or bank notes, contained in bin 60 to input pocket 10 of singling device 10, 20. Sheet material, or bank notes, are now resingled by singler 20 and supplied to transport system 40 to be rechecked by checking device 30.

In many cases a correct check was not possible upon the first check by checking device 30 because of faulty processes, e.g. because more than one bank note at a time was singled by singler 20 or because the bank note was transported askew by transport system 40 or because other disturbances prevented a correct or complete check. In the second check, the same faulty processes normally no longer exist so that sheet material, or bank-notes, can be checked correctly by checking device 30 and supplied to the corresponding deposit devices. Bank notes again recognized as faulty or false by checking device 30 are supplied to deposit device 50, 60 again. These bank notes can then be processed again as described above, i.e. they are supplied to singling device 10, 20 again. It is likewise possible for bank notes to be taken from bin 60 after one or more checks to be reworked by hand.

Besides the described return of bank notes by transport device 70 to singling device 10, 20, it can also be provided that bank notes recognized as faulty or false are fed directly to transport system 40 again before checking device 30, so that they are added to checking device 30 again without resingling. This necessitates that if sheet material, or bank notes, are still located in singling device 10, 20 singler 20 is stopped so that feed of the bank note to transport system 40 is possible.

It is likewise possible to supply bank notes recognized as false or faulty directly to input pocket 10 of singling device 10, 20 without collecting them in bin 60. For this purpose it can also be provided that, deviating from singling device 10, 20 shown, a singling device is used whereby the inserted stack of sheets is not singled by the singler from above but from below. Faulty or false bank notes can thus be placed directly on the stack of sheets, thereby retaining the original order of bank notes, or sheet material.

It is frequently also provided that sheet material processing apparatus 1 is used for processing sheet material, or bank notes, in a predetermined orientation. For example, bank notes are to be deposited front side up. Bank notes having another orientation are recognized by checking device 30 or their recognition is impossible since only check data for the predetermined orientation are present. Such bank notes are transported under the control of the control device of checking device 30 in transport system 40 as far as diverter 41 and transferred to deposit device 50, 60. Bank notes collected in bin 60 are then supplied to singling device 10, 20 again by transport device 70, as described above. Transport device 70 can additionally have a reversing device for reversing bank notes so that they have the desired orientation and can be processed accordingly by sheet material processing apparatus 1.

Further, it can be provided that the control device contained in checking device 30, or the separate control device, stores the data accruing during the check of sheet material, or bank notes, e.g. the data of the sensors. These data are of interest in particular for bank notes that are uncheckable or recognized as faulty, since these data can be used in the above-described recheck for coordinating and comparing the available data acquired in the recheck with the stored data of one or more prior checks. This can make it possible for the data combined in a plurality of checks to permit a correct check of sheet material, or bank notes.

Besides the data accruing in the check, accounting data can also be stored. Such accounting data are for example the abovementioned data, such as number of bank notes supplied to the individual deposit devices or their value. These data can be stored in the control device of checking device 30 or in the separate control device, as described above. The stored accounting data are updated in the recheck of bank notes, i.e. the bank notes recognized in the recheck are added to the particular accounting data for the individual deposit devices or the value is changed in accordance with the recognized bank note.

Besides the above-described possibility of supplying sheet material, or bank notes, that cannot be checked clearly or were recognized as faulty to checking device 30 again by means of transport device 70, there is also the possibility of performing a recheck of sheet material, or bank notes, by means of further sheet material processing apparatus 100.

For this purpose, sheet material or bank notes to be rechecked are transferred by transport device 70, as described above, to input pocket 110 of further apparatus 100. To increase security it can be provided that the area of deposit device 50, 60, transport device 70 and further input device 110 is inaccessible to the operator since no accounting data have been determined for sheet material located therein. This avoids attempted fraud.

FIG. 2 shows a schematic representation of an embodiment of sheet material processing apparatus 100. Further apparatus 100 has not only input pocket 110 but also singler 120 forming further singling device 110, 120 together with input pocket 110. Sheet material singled by singler 120 is supplied to further transport system 140 and checked by further checking device 130. The function of further checking device 130 corresponds substantially to the function of checking device 30 described above in connection with apparatus 1. Sheet material checked by further checking device 130 is supplied to further deposit devices 150, 160, 151, 161, 162 and shredder 180 in accordance with the check result of further checking device 130. For this purpose, diverters 141, 142, 143 are provided in further transport system 140 that are driven in accordance with the results of further checking device 130 by a control device contained in further checking device 130, or a separate control device.

Further checking device 130 can be constructed substantially like checking device 30 described in connection with apparatus 1. This means that further checking device 130 contains sensors that check the same features of the sheet material, or bank notes, as the sensors contained in checking device 30. In addition it can be provided that further checking device 130 contains sensors that check features of the sheet material, or bank notes, that differ from the features checked by the sensors contained in checking device 30. For example, further checking device 130 can contain sensors that measure the weight of sheet material to be checked, sensors that perform an olfactory analysis, or sensors that perform a chemical analysis.

In addition, further components of further apparatus 100 can be designed differently from the components of apparatus 1. For example, it can be provided that further transport system 140 transports sheet material, or bank notes, in the direction of their short side whereas transport system 40 of apparatus 1 transports them in the direction of their long side. Sheet material, or bank notes, are accordingly checked in further checking device 130 along the short side whereas they are checked in checking device 30 along the long side. Transport devices 40 and 140 can of course also work conversely, i.e. transport device 40 transports sheet material along the short side whereas transport device 140 transports sheet material along the long side.

In addition, it can be provided that sheet material, or bank notes, are transported in apparatuses 1 and 100 at different speeds.

The use of different transport systems or different transport speeds and different sensor systems in apparatuses 1 and 100 can permit sheet material, or bank notes, recognized as faulty or not clearly checkable in first apparatus 1 to be checked correctly in further apparatus 100, since faulty processes occurring in first apparatus 1 and caused for example by the special design of apparatus 1 are avoided in further apparatus 100, since the latter has a design deviating from the design of first apparatus 1. The use of different sensor systems has advantages in particular for damaged bank notes or sheet material, i.e. bank notes or sheet material that is dirty or has holes, since the operation of the different sensors and the different evaluation algorithms for the sensors in checking devices 30 and 130 normally perform different weightings, so that bank notes or sheet material that cannot be checked by one of checking devices 30 and 130 can be checked correctly by the other checking device.

As described above for checking device 30, it can also be provided for further checking device 130 that data accruing in the check of sheet material, or bank notes, are compared or supplemented with check data accruing in the check of the corresponding sheet material, or bank note, in checking device 30 and stored by checking device 30, or its control device, or the separate control device.

It is likewise possible, as described above, that accounting data are determined in further checking device 130 that relate to bank notes, or sheet material, transferred to and deposited in further deposit devices 150, 160, 151, 161, 162, 180 and for completing the total accounting data are transmitted to checking device 30 in order to supplement or change the accounting data already stored there. Further checking device 130 can also be designed to perform a static check of sheet material or bank notes. For this purpose it is possible that further transport system 140 is stopped when a piece of sheet material, or bank note, is located in the area of checking device 130. A further possibility is to illuminate transported sheet material by means of flashlight or strobe illumination and evaluate it by means of the sensors in checking device 130.

Sheet material, or bank notes, recognized as faulty or false after rechecking can be taken from bin 60 of apparatus 1 or bin 162 of apparatus 100 and reworked manually in known fashion. For this purpose an external checking device can be provided to which the data of the check by checking devices 30 and 130 are transferred in order to be displayed to an operator. For example, pictures taken of sheet material can be displayed on a monitor to permit them to be evaluated by the operator. The external checking device can in addition have an input device that allows the operator to input the result of the manual check. The external checking device can also be disposed in remote places, i.e. not in the direct proximity of apparatuses 1 and 100, e.g. in a central bank. The data of the check are then transferred by known transfer devices to the place of the external checking device. The manual check can be done for example by checking the transferred data or by checking the faulty or false sheet material itself. The thus inputted data constitute accounting data that are transferred to the controller of checking device 30, or the separate controller, and supplement or change the accounting data stored there.

In a special embodiment, sensors can be provided in checking device 130 that permit a sensory check by an operator. The information on sheet material detected by the sensors, such as stiffness, strength, roughness, etc., is transferred to the external checking device and made accessible to the operator. A glove (cyber glove or virtual-reality glove) can be used that permits the operator to perform a sensory check, as by palpating and feeling the sheet material.

For the check by an operator by means of the external checking device it can also be provided that transport system 140 is stopped while sheet material to be checked is located in further checking device 130. Transport system 130 is then activated again only when the check result has been inputted by the operator by means of the input device after the check.

Checking device 30 can further have a sensor that ascertains whether more than one piece of sheet material at a time was removed. If the sensor ascertains that precisely two pieces of sheet material were removed together from the stack of sheets by singling device 10, 20, the two connected pieces of sheet material can be caused to be placed in deposit device 50, 60 via transport system 40 and diverter 41. Transport device 70 and the above-described reversing device are used to reverse the connected pieces of sheet material and input them to singling device 10, 20 again. In resingling, it is then possible either that the two connected pieces of sheet material are separated and checked individually, or that they can be checked from the other side. In this way it is possible to check the two connected pieces of sheet material correctly by means of checking device 30.

Shredder 180 contained in further apparatus 100 can be used for destroying sheet material recognized as authentic during the check in further checking device 130. The shredder is preferably supplied sheet material that is authentic but does not fulfill certain criteria, such as soiling or fitness, as described above. Alternatively, shredder 180 can also destroy all the sheet material supplied to apparatus 100. The above-described detection of individual features can be done for all destroyed pieces of sheet material.

Described sheet material processing apparatus 1 or further sheet material processing apparatus 100 can also be suitable for so-called deposit processing. This refers to the stack of sheets containing a plurality of different single stacks that are separated for example by means of separation cards. The separation cards can contain information identifying the individual partial stacks, the so-called deposits. These data can comprise for example an account number to be credited with the bank notes forming the stack of sheets. The separation card can likewise contain information about the stack of sheets, e.g. which denomination and which number of bank notes are contained in the stack. The information on the separation card can be encoded e.g. optically or magnetically and detected for example by the sensors of checking devices 30 and 130.

Since it is necessary in deposit processing that in particular faulty or false bank notes be assigned their origin, it is provided that the separation cards are placed after singling by singler 20 or 120 in deposit device 60 or 162 where the false or faulty bank notes are placed. The false or faulty bank notes of the associated deposit are then placed on the particular deposited separation card. If no false or faulty bank notes occur in a deposit, the separation card of the next deposit is placed directly on the separation card of this deposit without any bank notes being located therebetween. It is thus possible to clearly retrace the origin of faulty or false bank notes. It is likewise possible to supply the thus formed stack of separation cards and bank notes, or sheet material, to singling device 10, 20 again, for which purpose the stack is transferred by transport device 70 to input pocket 10, the bank note stack being reversed by the reversing device of transport device 70 so as to pass into singling device 10, 20 in the original order. If further processing of the thus formed stack is to be effected in further apparatus 100, it is not necessary to reverse the stack since singling device 110, 120 of further apparatus 100 singles the stack from below.

In a further embodiment it is provided that one apparatus 100 is provided for a plurality of apparatuses 1. In this case, transport device 70 must be designed so as to transport sheet material accumulating in deposit devices 50, 60 of individual apparatuses 1 to input pocket 110 of further apparatus 100.

FIG. 3 shows the embodiment according to FIG. 1 as a flowchart. Comparable elements in FIGS. 1 and 3 have the same reference signs. In first automatic check 1 sheet material is singled 10, 20, transported 40 and checked 30. If sheet material can be clearly assigned 41, 42, 43 it is deposited 51, 61 or 52, 62 or 44. If no clear assignment 41 can be performed, sheet material is deposited 50, 60 to be supplied 70 to a recheck 1. The recheck can be a further automatic check 100. In the further automatic check 100 sheet material is singled 110, 120, transported 140 and checked 130. If sheet material can be clearly assigned 141, 142, 143 it is deposited 150, 160 or 151, 161 or destroyed 180. If no clear assignment 141, 142, 143 can be performed, sheet material is deposited 162. This sheet material can be reworked manually.

A further improvement can be obtained if a marking apparatus, e.g. an ink jet printer, is mounted after checking device or devices 30, 130 for marking sheet material that is not clearly assignable. Marking can be done e.g. in the form of a machine-readable bar code or in the form of plain writing. It is particularly expedient to use an ink that cannot be perceived by a viewer's eye, e.g. fluorescent ink. Sheet material can be marked by the marking apparatus after the first and/or repeated check.

A corresponding coding of the marking applied to sheet material can be used to clearly identify the sheet material in subsequent rechecks. This makes it possible to clearly relate measuring results from different checks.

It is also possible to evaluate the markings in a final manual check. If an invisible ink was used, a corresponding reading device must be used to make the markings visible. This makes it possible to identify the causes of unassignability by checking device 30, 130 since the stored measuring data are assigned to the marked sheet material, or contained on the sheet material in the marking. This facilitates manual assignment since it provides clear indications of the probable error or defect of the sheet material that led to unassignability.

The invention claimed is:

1. In an apparatus for processing sheet material, having:
- a singling device for singling a stack of sheets;
- a transport system for transporting the singled sheet material;
- a checking device disposed along the transport system for checking the singled sheet material, and
- at least two deposit devices for depositing sheet material in dependence on the result of the checking device;

the improvement comprising:
- a transport device arranged to deliver sheet material that cannot be clearly checked and/or is recognized as faulty by the checking device to at least one recheck path where a recheck is performed using a further sheet material processing apparatus, and
- the further sheet material processing apparatus includes a further transport system, a further checking device disposed along the further transport system, and at least two further deposit devices.

2. The apparatus according to claim 1, wherein a bin is disposed between the transport device and the singling device for receiving sheet material that cannot be clearly checked and/or is recognized as faulty by the checking device, the transport device arranged to transfer sheet material collected in the bin to the further sheet material processing apparatus.

3. The apparatus according to claim 2, wherein the bin comprises one of the deposit devices.

4. The apparatus according to claim 1, wherein the transport device contains a reversing device arranged to reverse sheet material that cannot be clearly checked and/or is recognized as faulty by the checking device.

5. The apparatus according to claim 1, wherein said transport device is arranged to deliver sheet material that cannot be clearly checked and/or is recognized as faulty by the checking device to a further singling device of the further sheet material processing apparatus.

6. The apparatus according to claim 1, wherein the further checking device is arranged to check features of the sheet material being processed that are also checked by the checking device.

7. The apparatus according to claim 1, wherein the further checking device is arranged to check features of said sheet material that differ from the features checked by the checking device.

8. The apparatus according to claim 1, wherein sheet material processed in the apparatus includes a long and short side, and said transport system transports said sheet material for processing in the direction of its long side whereas sheet material is transported for processing by said further transport system in the further sheet material processing apparatus in the direction of its short side, or vice versa.

9. The apparatus according to claim 1, wherein said transport system and said further transport system are arranged so that sheet material is transported in the apparatus at a higher speed than in the further sheet material processing apparatus, or vice versa.

10. The apparatus according to claim 1, wherein the checking device includes a storing device for data of the check of sheet material, and further wherein the further checking device is arranged to determine further data of the check of sheet material and to evaluate the further data with data of the check of sheet material stored in the checking device, at least some of the data of the check of sheet material stored in the checking device relating to sheet material previously not clearly checked and/or recognized as faulty.

11. The apparatus according to claim 1, wherein the further checking device is arranged to determine accounting data for sheet material stored in the further deposit devices and transfers said data to the checking device, and the checking device includes a device to store accounting data for sheet material placed in the deposit devices and is arranged so as to supplement and/or change the stored accounting data with the accounting data of the further checking device.

12. The apparatus according to claim 1, wherein the further checking device is arranged to perform a static check of sheet material, for which purpose the further checking device is operable to stop the further transport device if sheet material to be checked is located in the area of the further checking device and/or only briefly illuminates the sheet material.

13. In an apparatus for processing sheet material, having a singling device for singling a stack of sheets, a transport system for transporting the singled sheet material, a checking device disposed along the transport system for checking the singled sheet material, and at least two deposit devices for depositing sheet material in dependence on the result of the checking device, a transport device arranged to deliver sheet material that cannot be clearly checked and/or is recognized as faulty by the checking device to at least one recheck path where a recheck is performed by a further checking device of a further sheet material processing apparatus;

wherein the further checking device is located along a further transport system and arranged to transfer data of the check of sheet material for evaluation to an external checking device.

14. The apparatus according to claim 13, wherein the external checking device has a device that enables evaluation of the data of the check by an operator.

15. The apparatus according to claim 13, wherein the external checking device and the apparatus are located in different places, and the external checking device receives the data of the check from the apparatus via a data connection.

16. The apparatus according to claim 1, wherein the checking device is arranged to ascertain whether only one piece of sheet material at a time is checked or whether a plurality of pieces of sheet material are connected and transported by the transport system through the checking device.

17. The apparatus according to claim 16, including a reversing device in the transport device, and wherein upon the checking device ascertaining that precisely two pieces of sheet material are connected, said checking device is arranged to actuate said reversing drive so as to thereby reverse the two connected pieces of sheet material.

18. The apparatus according to claim 1, wherein the further sheet material processing apparatus includes a shredder, and a device for supplying sheet material recognized as authentic by the further checking device to the shredder.

19. The apparatus according to claim 1, wherein a marking apparatus is disposed after the checking device and/or the further checking device.

* * * * *